US007542030B2

(12) United States Patent
Jang et al.

(10) Patent No.: US 7,542,030 B2
(45) Date of Patent: Jun. 2, 2009

(54) DISPLAY PANEL DRIVING CIRCUITS AND METHODS FOR DRIVING IMAGE DATA FROM MULTIPLE SOURCES WITHIN A FRAME

(75) Inventors: Min-hwa Jang, Gyeonggi-do (KR); Yong-guen Ku, Gyeonggi-do (KR)

(73) Assignee: Samsung Electronics Co., Ltd. (KR)

( * ) Notice: Subject to any disclaimer, the term of this patent is extended or adjusted under 35 U.S.C. 154(b) by 832 days.

(21) Appl. No.: 10/947,709

(22) Filed: Sep. 23, 2004

(65) Prior Publication Data

US 2005/0068288 A1 Mar. 31, 2005

(30) Foreign Application Priority Data

Sep. 25, 2003 (KR) ..... 10-2003-0066496

(51) Int. Cl.
*G09G 5/00* (2006.01)

(52) U.S. Cl. ..... 345/204; 345/98; 345/100; 345/501; 345/530; 345/667; 348/581; 348/584; 348/588

(58) Field of Classification Search ..... 345/98, 345/100, 204, 501, 530, 531, 535, 660, 667
See application file for complete search history.

(56) References Cited

U.S. PATENT DOCUMENTS 6,384,846 B1 * 5/2002 Hiroi ..... 715/794
6,614,439 B2 * 9/2003 Matsumoto et al. ..... 345/530

* cited by examiner

*Primary Examiner*—Richard Hjerpe
*Assistant Examiner*—Jennifer T Nguyen
(74) *Attorney, Agent, or Firm*—Myers Bigel Sibley & Sajovec

(57) ABSTRACT

Display panel driving circuits and methods of driving a display panel with first video data and second video data include determining a starting position and a stopping position of the first video data if the first video data is window data and reducing the size of the first video data if the first video data is full screen data. Alternating lines of a first portion of the display panel and a second portion of the display panel are driven with the reduced size first video data and the second video data so as to display the reduced size first video data in the first portion of the display panel and the second video data in the second portion of the display panel if the first video data is full screen data. Lines of a portion of the display panel corresponding to the starting position and the stopping position are driven with the first video data and remaining portions of the display panel are sequentially driven with the second video data so as to display the first video data in the portion of the display panel corresponding to the starting position and the stopping position and the second video data in the remaining portions of the display panel. Subcombinations are also provided.

38 Claims, 12 Drawing Sheets

DISPLAY PANEL DRIVING CIRCUITS AND METHODS FOR DRIVING IMAGE DATA FROM MULTIPLE SOURCES WITHIN A FRAME

CLAIM OF PRIORITY AND RELATED APPLICATIONS

This application is related to and claims priority from Korean Patent Application No. 2003-66496, filed on Sep. 25, 2003, in the Korean Intellectual Property Office, the disclosure of which is incorporated herein in its entirety by reference.

FIELD OF THE INVENTION

The present invention relates to display panel driving circuits and methods and, more particularly, to panel driving circuits and methods for displaying still and moving images.

BACKGROUND OF THE INVENTION

FIG. 1 is a block diagram of a conventional panel driving circuit. The conventional panel driving circuit 100 includes a graphic memory 120 and an OSD (On Screen Display) memory 130. The graphic memory 120 corresponds to one frame size. Background data DI and OSD data OSD_DATA, that correspond to an image to be displayed on a panel 150, are output from a microprocessor interface 110 and stored in the graphic memory 120 and the OSD memory 130.

The graphic memory 120 and the OSD memory 130 transmit the background data SDOUT_PRE and OSD data OSD_DATA to an alpha-blending circuit 140. The alpha-blending circuit 140 blends the background data SDOUT_PRE and OSD data OSD_DATA with each other in a specific ratio and transmits the blended data SDOUT to the panel 150.

FIG. 2 is a block diagram of a conventional panel driving circuit that simultaneously receives a moving image and a still image and displays them. The panel driving circuit 200 receives moving image data MD via a moving image interface 210 and still image data SD via a microprocessor interface 220, which are then sent to a MUX 230.

The MUX 230 selects one of the moving image data MD and the still image data SD under the control of a controller 280, and the selected data is stored in a memory 240. A source driver 250 and a gate driver 260 transmit the moving image data MD or still image data SD stored in the memory 240 to a panel 270. The still image data SD is typically not transmitted to the panel 270 if the moving image MD is transmitted to the panel 270.

FIG. 3 is a timing diagram illustrating the operation of the panel driving circuit of FIG. 2. Referring to FIG. 3, a vertical synchronization signal VSYNC is activated once for each frame. Dot CLOCK is a reference clock signal. The moving image data MD typically cannot be transmitted to the panel 270 while the still image data SD is being displayed by the panel 270. That is, after a first frame 1F of the moving image data MD is sent to the panel 270(i), second, third and fourth frames 2F, 3F and 4F of the moving image data MD typically cannot be transmitted because the still image data SD is transmitted to the panel 270(ii).

As described above, the conventional panel driving circuit, typically, cannot transmit the moving image data and still image data to the panel simultaneously. Furthermore, the circuit should store the moving image data in the memory thereby increasing current consumption.

SUMMARY OF THE INVENTION

Some embodiments of the present invention provide display panel driving circuits that include a shift register configured to store first video data corresponding to a size of one line of a panel in response to a first control signal. A memory is configured to store second video data in response to a second control signal and output an amount of the second video data corresponding to the size of one line of the panel. A line packing circuit is configured to control a size of the first video data output from the shift register and a position of the first video data on the display panel, and output the first video data and the second video data in a first output mode or a second output mode in response to a third control signal. A gate line sorting circuit is configured to control an enabling sequence of first through nth gate line signals for enabling n gate lines of the panel in response to a fourth control signal according to whether the first video data and the second video data are output in the first output mode or second output mode. A gate driver circuit is configured to enable gate lines of the display panel in response to the gate line signals output from the gate line sorting circuit and a fifth control signal and a source driver circuit is configured to provide the first video data and the second video data output from the line packing circuit to the display panel in response to a sixth control signal. In the first output mode, the first and second video data are alternately output, and in the second output mode, the first video data is output for a first predetermined period of time and then the second video data is output for a second predetermined period of time.

In further embodiments of the present invention, the line packing circuit includes a size controller configured to reduce the size of the first video data if the first video data is full screen data, a first data position determining unit configured to determine a position of the first video data output from the size controller on a panel line, a second data position determining unit configured to determine a position of the first video data on a panel line when the first video data is window data that is displayed at a specific position on the display panel, a first selector configured to output the first video data output from the first data position determining unit or the first video data output from the second data position determining unit in response to a first select signal and a second selector configured to output the first video data output from the first selector or the second video data in response to a second select signal. The first and second select signals may be generated based on the third control signal. The second selector may output the first video data and the second video data in the first output mode in response to the second select signal if the first video data is full screen data and output the first video data and the second video data in the second output mode in response to the second select signal when the first video data is window data. The size controller may reduce the size of the first video data by half.

In additional embodiments of the present invention, the gate line sorting circuit alternately sequentially enables gate line signals for a first half of the display panel and gate line signals for a second half of the display panel in response to the fourth control signal when the first video data and the second video data are output in the first output mode. The gate line sorting circuit may sequentially enable gate line signals corresponding to display panel lines from a start point through an end point of the first video data and then sequentially enables gate line signals corresponding display panel lines from a point after the end point to a point before the start point of the first video data in response to the fourth control signal when the first video data and the second video data are output in the second output mode.

Further embodiments of the present invention include a controller configured to generate the first through sixth control signals, the fifth and sixth control signals being horizontal synchronization signals. Furthermore, the first video data may be moving image data and the second video data may be moving image data and/or still image data.

In additional embodiments of the present invention, methods of driving display panel include obtaining first video data from a first source corresponding to a size of one line of the display panel, obtaining second video data from a second source corresponding to the size of one line of the display panel, controlling the size of the first video data and a position of a display panel line where the first video data will be displayed and outputting the first video data and the second video data in a first output mode or second output mode according to whether the first video data is full screen data that is displayed on the entire screen of the panel or window data that is displayed at a specific position of the panel. An enabling sequence of first through nth gate line signals for enabling n gate lines of the display panel is controlled according to whether the first video data and the second video data are output in the first output mode or second output mode. The gate lines are enabled in the enabling sequence and a corresponding one of the first video data and the second video data provided to the display panel when a corresponding one of the gate lines are enabled.

In further embodiments of the present invention, in the first output mode, the first video data and the second video data are alternately output and in the second output mode, the first video data is output for a first predetermined period of time and the second video data is output for a second predetermined period of time to sequentially output the first video data and the second video data. Furthermore, controlling the size of the first video data and a position of a display panel line where the first video data will be displayed and outputting the first video data and the second video data in a first output mode or a second output mode may include reducing the size of the first video data if the first vide data is full screen data, determining a position of the first video data on a panel line and outputting the first video data and the second video data in the first output mode. A position of the first video data on a display panel may be determined if the first video data is window data and the first video data and the second video data output in the second output mode. Reducing the size of the first video data may include decreasing the size of the first video data by half.

In additional embodiments of the present invention, controlling an enabling sequence of the first to nth gate line signals includes controlling the enabling sequence where gate line signals following the first gate line signal and signals following the (n/2+1)th gate line signal are alternately enabled sequentially when the first video data and the second video data are output in the first output mode. Controlling an enabling sequence of the first to nth gate line signals may include controlling the enabling sequence where gate line signals for enabling gate lines corresponding to a start point through to an end point of the first video data on the display panel line are sequentially enabled, and then gate line signals corresponding to a point after the end point to a point before the start point are sequentially enabled when the first video data and the second video data are output in the second output mode. The first video data may be moving image data and the second video data may be moving image data or still image data.

Other embodiments of the present invention provide display panel driving circuits that include a shift register configured to store first video data corresponding to a size of one line of a panel in response to a first control signal, a memory configured to store second video data or OSD data input thereto and output an amount of the second video data or OSD data corresponding to the size of one line of the panel in response to a second control signal, a data control circuit configured to output a corresponding one of the first or second video data when only one of the first video data and the second video data is received, receive the first video data and the OSD data and output OSD-blended data, and receive the first video data and the second video data and output them in a first output mode or a second output mode in response to a third control signal, a gate line sorting circuit configured to control an enabling sequence of first through nth gate line signals for enabling n gate lines of the panel in response to a fourth control signal according to whether the first video data and the second video data are output in a first output mode or a second output mode, a gate driver configured to enable gate lines of the display panel in response to the gate line signals output from the gate line sorting circuit and a fifth control signal and a source driver configured to provide the first video data and the second video data output from the data control circuit to the display panel in response to a sixth control signal.

In additional embodiments of the present invention, the first output mode, the first video data and the second video data are alternately output and in the second output mode, the first video data is output for a predetermined period of time and then the second video data is output for a predetermined period of time. The data control circuit may include an alpha-blending circuit configured to blend the first video data with the OSD data in a specific ratio to produce the OSD-blended data, a line packing circuit configured to control the size of the first video data and a position on a display panel line where the first video data will be displayed and output the first video data and the second video data in the first output mode or second output mode in response to the third control signal and a selecting circuit configured to select the first video data when only the first video data is received, the second video data when only the second video data is received, the OSD-blended data or the output of the line packing circuit in response to an operation mode select signal.

The line packing circuit may include a size controller configured to reduce the size of the first video data, a first data position determining unit configured to determine a position of the first video data output from the size controller on a display panel, a second data position determining unit configured to determine a position of the first video data on a display panel when the first video data is window data that is displayed at a specific position on the panel, a first selector circuit configured to output the first video data output from the first data position determining unit or the first video data output from the second data position determining unit in response to a first select signal and a second selector circuit configured to output the first video data output from the first selector circuit or the second video data in response to a second select signal. The first and second select signals may be generated from the third control signal. The second selector circuit may alternately output the first video data and the second video data in the first output mode in response to the second select signal if the first video data is full screen data, and sequentially outputs the first video data and the second video data in the second output mode in response to the second select signal when the first video data is window data.

In further embodiments of the present invention, the size controller reduces the size of the first video data by half.

In additional embodiments of the present invention, the gate line sorting circuit alternately sequentially enables gate line signals for a first half of the display panel and gate line signals for a second half of the display panel in response to the fourth control signal when the first video data and the second video data are output in the first output mode. The gate line sorting circuit may sequentially enable gate line signals corresponding to display panel lines from a start point through an end point of the first video data and then sequentially enables gate line signals corresponding display panel lines from a point after the end point to a point before the start point of the first video data in response to the fourth control signal when the first video data and the second video data are output in the second output mode.

Further embodiments of the present invention include a controller configured to generate the first through sixth control signals, the fifth and sixth control signals being horizontal synchronization signals. Also, the first video data may be moving image data and the second video data may be moving image data or still image data. The panel driving circuit may also include a moving image interface receiving the first video data and transmitting it to the shift register and a microprocessor interface receiving the OSD data or the second video data and transmitting it to the memory.

In still further embodiments of the present invention, methods of driving a display panel include obtaining first video data corresponding to a size of one line of a display panel, obtaining second video data or OSD data corresponding to the size of one line of the display panel, outputting the first or second video data when only one of the first video data and the second video data is received, outputting OSD-blended data in which an image corresponding to the OSD data is displayed on an image corresponding to the first video data when first video data and OSD data is received, or controlling the size of the first video data and a position on a panel line where the first video data will be displayed and outputting the first video data and the second video data in a first output mode or a second output mode according to whether the first video data is full screen data or window data, controlling an enabling sequence of first through nth gate line signals for enabling n gate lines of the panel according to whether the first video data and the second video data are output in the first output mode or second output mode, enabling gate lines in response to the enabled gate line signals and/or horizontal synchronization signals and providing the first video data and the second video data to the display panel in response to the horizontal synchronization signals.

In some embodiments of the present invention, the first output mode, the first video data and the second video data are alternately output and in the second output mode, the first video data is output for a first predetermined period of time and then the second video data is output for a second predetermined period of time. Outputting the first video data and the second video data in the first output mode or second output mode may include reducing a size of the first video data if the first video data is full screen data, determining a position of the first video data on a display panel and outputting the first video data and the second video data in the first output mode. Outputting the first video data and the second video data in the first output mode or second output mode may also include determining a position of the first video data on a display panel if the first video data is window data and outputting the first video data and the second video data in the second output mode.

Some embodiments of the present invention also include blending the first video data with the OSD data in a predetermined ratio and outputting the OSD-blended data when the first video data and the OSD data are received. The first video data is selected and output when only the first video data is received, the second video data is selected and output when only the second video data is received, or the OSD-blended data and data output in the first output mode or second output mode is selected and output.

Furthermore, reducing the size of the first video data may include decreasing the size of the first video data by half.

Controlling an enabling sequence of the first to nth gate line signals may include controlling the enabling sequence where gate line signals following the first gate line signal and signals following the (n/2+1)th gate line signal are alternately enabled sequentially when the first video data and the second video data are output in the first output mode. Controlling an enabling sequence of the first to nth gate line signals could include controlling the enabling sequence where gate line signals for enabling gate lines corresponding to a start point through to an end point of the first video data on the display panel line are sequentially enabled, and then gate line signals corresponding to a point after the end point to a point before the start point are sequentially enabled when the first video data and the second video data are output in the second output mode. The first video data may be moving image data and the second video data may be moving image data or still image data.

DETAILED DESCRIPTION OF THE INVENTION

Figure 1:
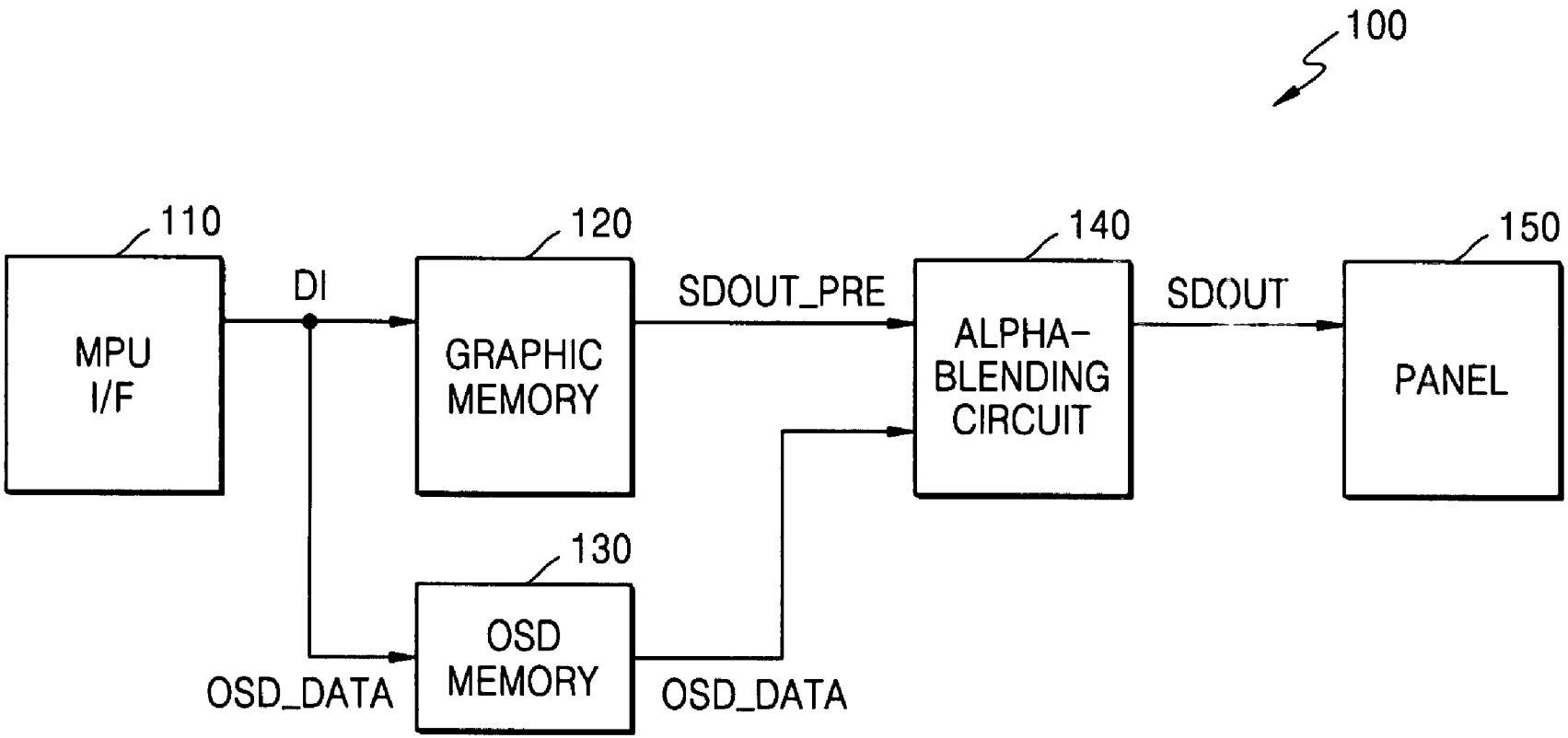
FIG. 1 (PRIOR ART)
FIG. 1 is a block diagram of a conventional panel driving circuit.
Figure 2:
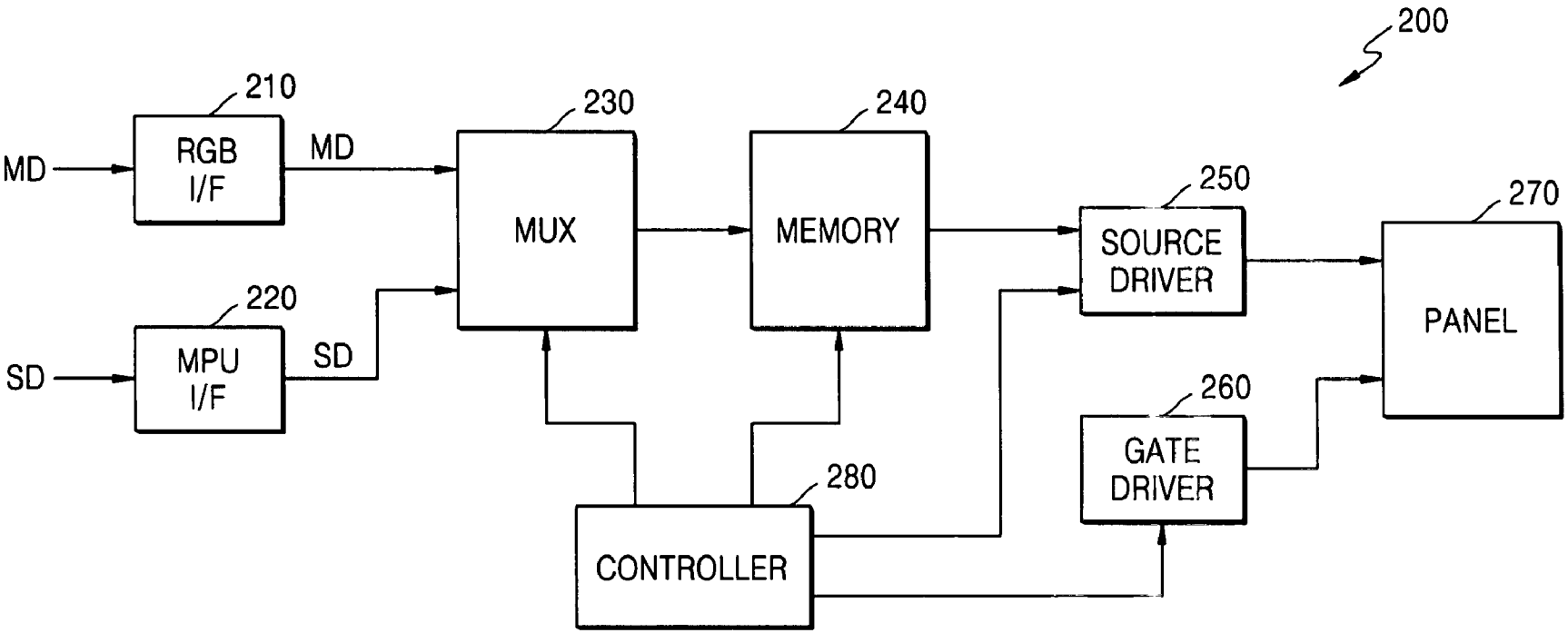
FIG. 2 (PRIOR ART)
FIG. 2 is a block diagram of a conventional panel driving circuit that simultaneously receives a moving image and a still image to display them.

The present invention will now be described more fully with reference to the accompanying drawings, in which embodiments of the invention are shown. This invention may, however, be embodied in different forms and should not be construed as being limited to the embodiments set forth herein. Rather, these embodiments are provided so that this disclosure will be thorough and complete, and will fully convey the scope of the invention to those skilled in the art. In the drawings, the size or thickness of layers and regions are exaggerated for clarity. Like numbers refer to like elements. As used herein the term "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 4:
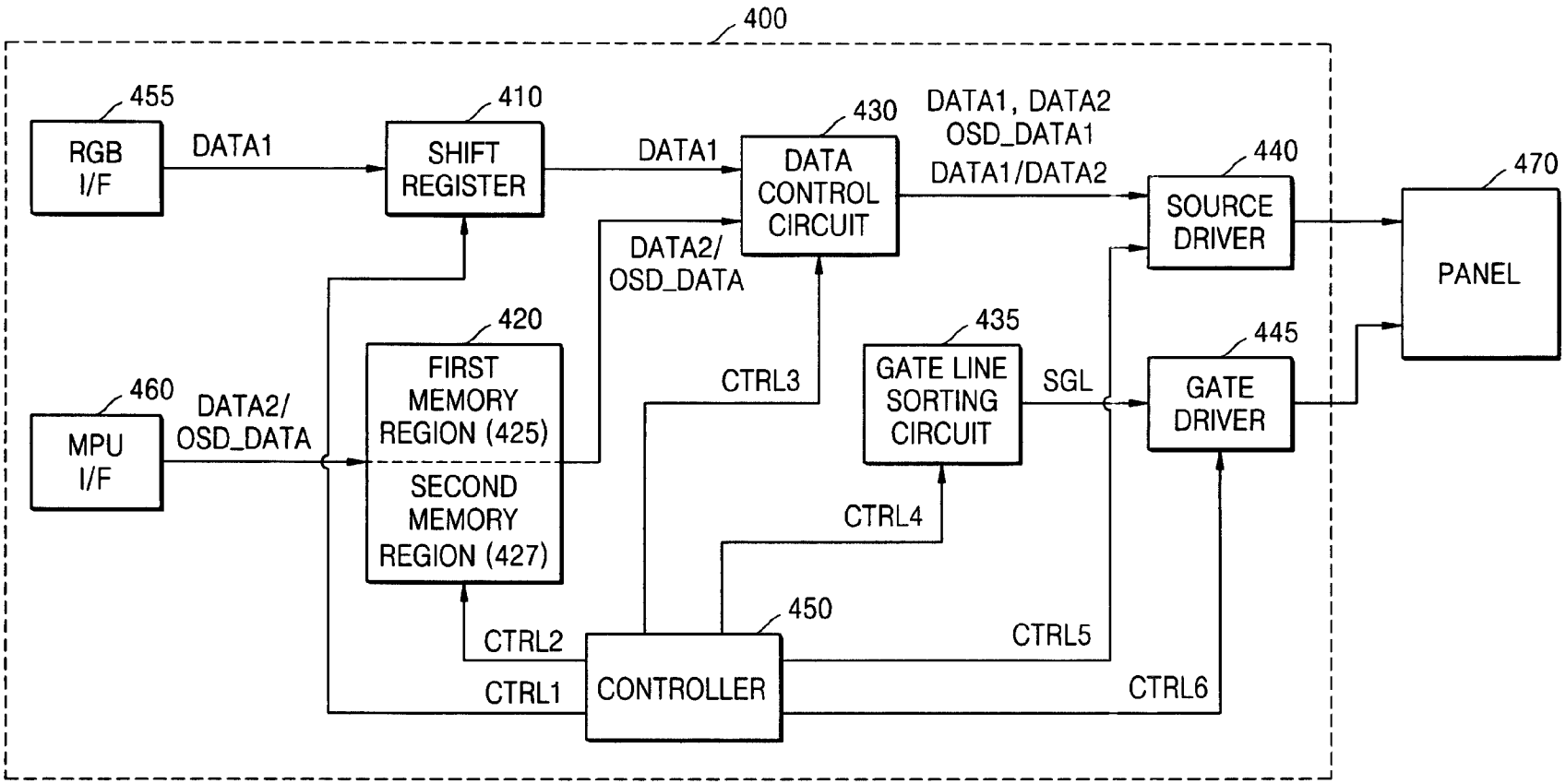
FIG. 4 is a block diagram of a panel driving circuit according to some embodiments of the present invention.

FIG. 4 is a block diagram of a panel driving circuit according to some embodiments of the present invention. The panel driving circuit 400 displays a moving image or a still image on a display panel 470 when it receives only a corresponding one of moving image data or still image data. In the case that both moving image data and still image data are received, the panel driving circuit 400 combines the moving image data and the still image data in a specific ratio and displays an image generated by the combined moving image data and still image data on the display panel 470. The display panel 470 may, for example, be a liquid crystal display (LCD) panel, a plasma display panel, an organic light emitting device (OLED) or other such display panels.

When the panel driving circuit 400 receives more moving image data or still image data from an external device while a moving image is being displayed on the display panel 470, the size of the moving image being displayed on the display panel 470 is reduced and an image generated by the received moving image data or still image data is displayed on the remaining space of the display panel 470.

In some embodiments of the present invention, the panel driving circuit 400 includes a shift register 410, a memory 420, a data control circuit 430, a gate line sorting circuit 435, a gate driver circuit 445 and a source driver circuit 440. The shift register 410 stores first video data DATA1 corresponding to the size of one line of the panel 470 in response to a first control signal CTRL1 and then outputs the stored line of data. The first video data DATA1 is moving image data.

In some embodiments of the present invention, the panel driving circuit 400 can further include a moving image interface 455 that receives the first video data DATA1 and transmits it to the shift register 410. That is, the moving image interface 455 receives moving image data from an external device and transmits it to the shift register 410. The shift register 410 can store data corresponding to one line of the display panel 470.

The memory 420 stores second video data DATA2 or OSD data OSD_DATA input thereto, and outputs the second video data DATA2 or OSD data OSD_DATA in units equal to the size of one line of the panel 470 in response to a second control signal CTRL2. The memory 420 is divided into first and second memory regions 425 and 427. The first memory region 425 stores the OSD data OSD_DATA while the second memory region 427 stores the second video data DATA2. In some embodiments of the present invention, the panel driving circuit 400 does not include a separate OSD memory. Instead the panel driving circuit divides the memory 420 into a first region 425 for storing the OSD data OSD_DATA and a second region 427 for storing the second video data DATA2.

The second video data DATA2 may be moving image data or still image data. The panel driving circuit 400 further includes a microprocessor interface 460 that receives the second video data DATA2 or OSD data OSD_DATA and transmits the received data to the memory 420. That is, the microprocessor interface 460 receives moving image data or still image data from an external device and provides the received data to the memory 420.

When only one of the first video data DATA1 and the second video data DATA2 is received, the data control circuit 430 outputs the received first or second video data DATA1 or DATA2 as received. When both of the first video data DATA1 and OSD data OSD_DATA are received, the data control circuit 430 outputs OSD-blended data OSD_DATA1 which generates an image in which an image corresponding to the OSD data OSD_DATA is displayed on an image corresponding to the first video data DATA1. When the first video data DATA1 and the second video data DATA2 are received, the data control circuit 430 outputs the first video data DATA1 and the second video data DATA2 in a first output mode or a second output mode in response to a third control signal CTRL3.

Figure 5:
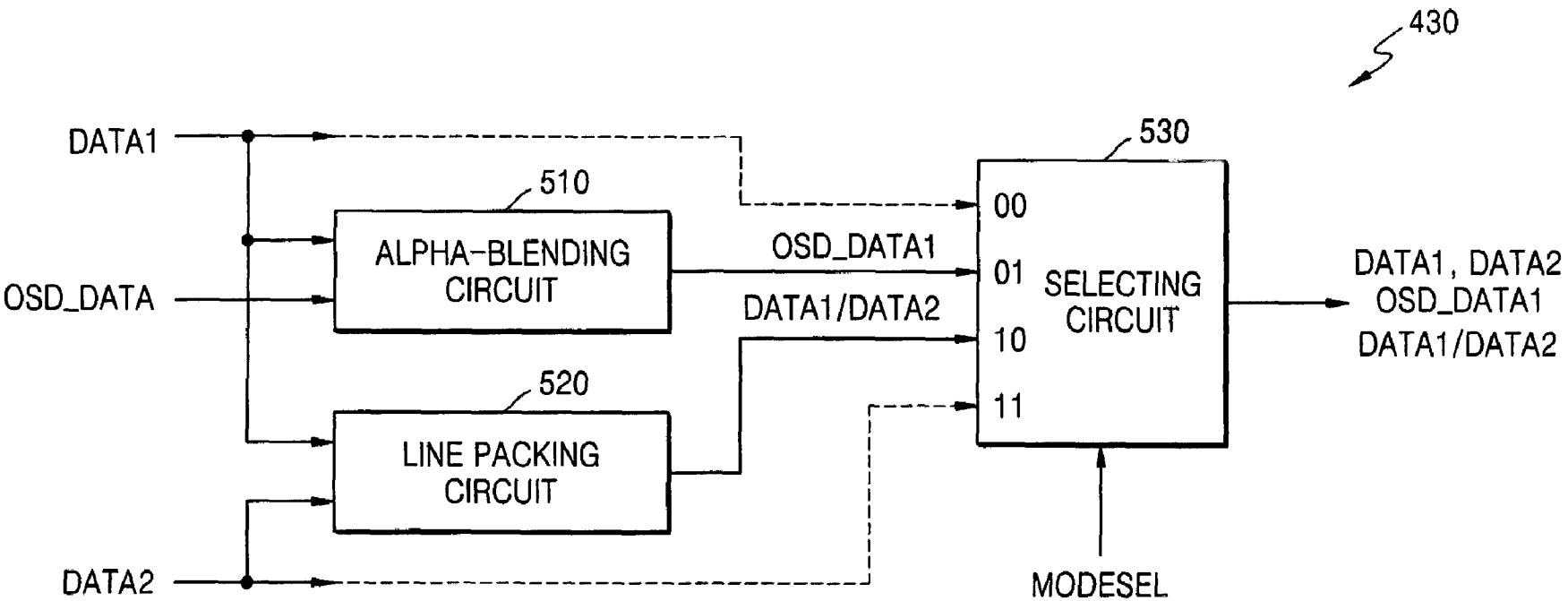
FIG. 5 is a detailed block diagram of a data control circuit of FIG. 4 according to some embodiments of the present invention.

The operation of the data control circuit 430 according to some embodiments of the present invention will now be explained in more detail with reference to FIG. 5. FIG. 5 is a detailed block diagram of the data control circuit 430 of FIG. 4 according to some embodiments of the present invention.

Referring to FIG. 5, the data control circuit 430 includes an alpha-blending circuit 510, a line packing circuit 520 and a selecting circuit 530. The alpha-blending circuit 510 receives the first video data DATA1 and OSD data OSD_DATA and blends them together in a specific ratio and outputs the OSD-blended data OSD_DATA1 to the selecting circuit 530 for output to the display panel 470. The image corresponding to the first video data DATA1 becomes a background image and the image corresponding to the OSD data OSD_DATA is displayed on the background image. Brightness and color of the images corresponding to the first video data DATA1 and OSD data OSD_DATA are determined according to the blending ratio.

The line packing circuit 520 controls the size of the first video data DATA1 and a position on a line of the panel 470 where the image corresponding to the first video data DATA1 will be displayed, and then outputs the first video data DATA1 and the second video data DATA2 in the first or second output mode in response to the third control signal CTRL3.

The selecting circuit 530 selects the first video data DATA1 when only the first video data DATA1 is received or the second video data DATA2 when only the second video data DATA2 is received in response to an operation mode select signal MODESEL. The selecting circuit 530 also selects one of the OSD-blended data OSD_DATA1 and the output DATA1/DATA2 of the line packing circuit 520 in response to an operation mode select signal MODESEL. The operation mode select signal MODESEL is output from a controller 450 which will be described later.

Figure 6:
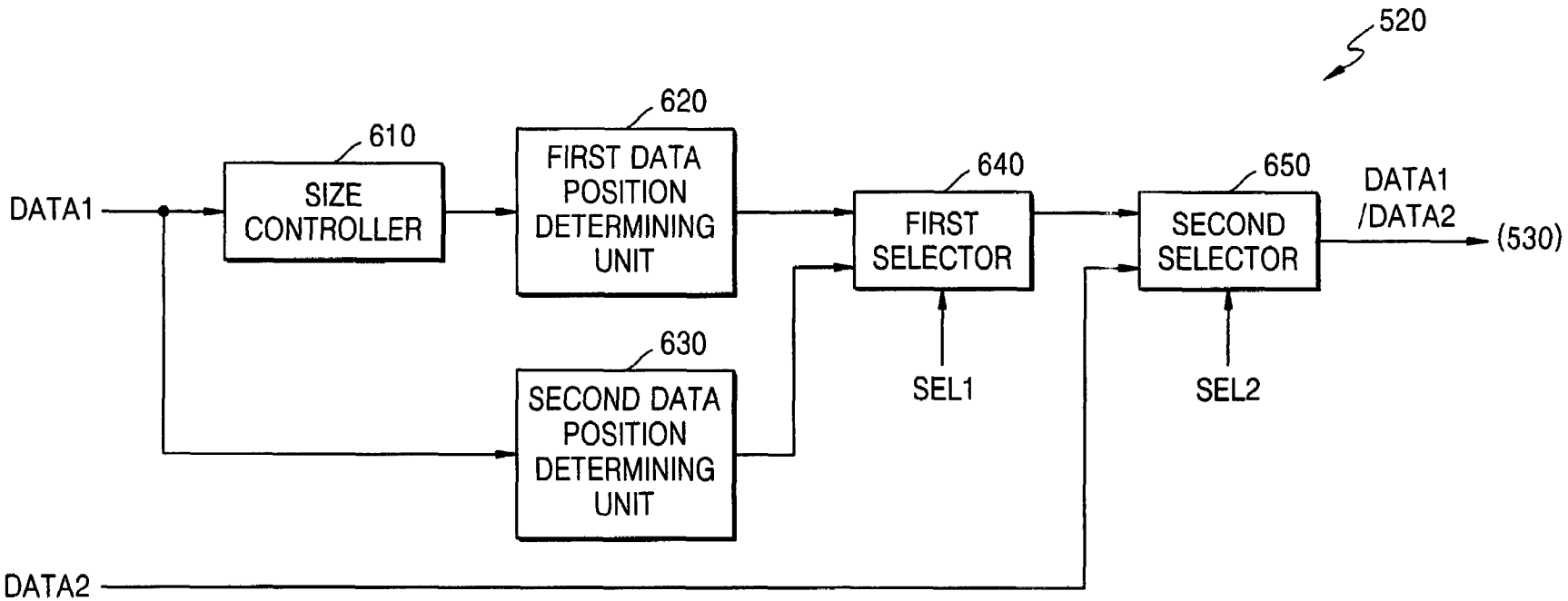
FIG. 6 is a detailed block diagram of a line packing circuit of FIG. 5 according to some embodiments of the present invention.

The operation of the line packing circuit 520 according to some embodiments of the present invention will now be explained in more detail with reference to FIGS. 6 and 7. FIG. 6 is a detailed block diagram of the line packing circuit 520 of FIG. 5, and FIG. 7 is a diagram illustrating the operation of the line packing circuit of FIG. 5.

The line packing circuit 520 controls the size of the first video data DATA1 and displays the image corresponding to the first video data DATA1 on a part of the display panel 470 if the first video data DATA1 is full screen data that is displayed on the entire display panel 470. The line packing circuit displays the image generated by the second video data DATA2 on the remaining space of the screen of the panel 470. If the first video data DATA1 is window data that generates an image displayed on a specific portion of the display panel 470, the line packing circuit 520 displays the image generated by the second video data DATA2 on a portion of the display panel 470 where the image generated by the first video data DATA1 is not displayed.

Referring to FIG. 6, the line packing circuit 520 includes a size controller 610, a first data position determining unit 620, a second data position determining unit 630, a first selector 640 and a second selector 650. The size controller 610 resizes the first video data DATA1 when the first video data DATA1 is full screen data that generates an image that is displayed on the entire display panel 470. The size controller 610 reduces the size of the first video data DATA1 by half.

Figure 7:
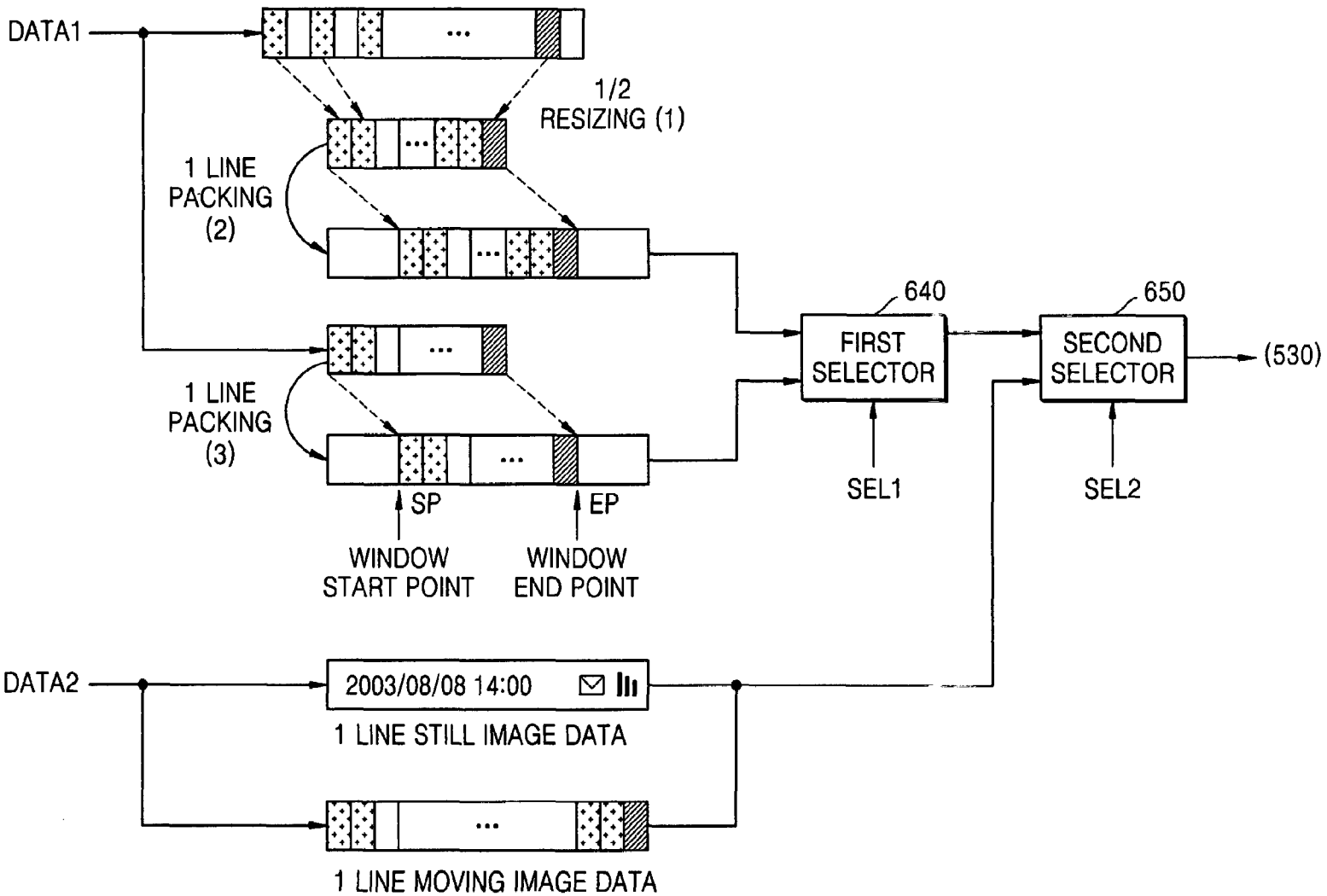
FIG. 7 is a diagram illustrating operations of the line packing circuit of FIG. 5.

Referring to FIG. 7, the operation of reducing the size of the first video data DATA1 by half is shown as (1). The line packing circuit 520 selects every other pixel data (e.g., only odd-numbered pixel data or even-numbered pixel data) from the pixel data of the first video data DATA1 having the size corresponding to one line of the display panel 470 to obtain the first video data DATA1 whose size has been reduced by half.

The first data position determining unit 620 determines a position of the first video data DATA1 of a panel line output from the size controller 610. Referring to FIG. 7, the operation of determining the position of the first video data DATA1 on the panel line is shown as (2). While the first video data DATA1 is arranged in the middle of the panel line in FIG. 7, it is not limited thereto.

The second data position determining unit 630 determines a position of the first video data DATA1 on a line of the display panel 470 if the first video data DATA1 is window data that generates an image to be displayed at a specific position of the display panel 470. Referring to FIG. 7, the operation of determining the position of the first video data DATA1 on the panel line is shown as (3). The second data position determining unit 630 determines a start point SP and an end point EP of the first video data DATA1 arranged on the panel line.

The first selector 640 outputs one of the first video data DATA1 output from the first data position determining unit 620 and the first video data DATA1 output from the second data position determining unit 630 in response to a first select signal SEL1.

The second selector 650 outputs the first video data DATA1 output from the first selector 640 and/or the second video data DATA2 in response to a second select signal SEL2. FIG. 7 illustrates a case where the second video data DATA2 is moving image data and a case where it is still image data. The first and second select signals SEL1 and SEL2 are generated from the third control signal CTRL3. The second selector 650 outputs the first video data DATA1 and the second video data DATA2 in the first output mode in response to the second select signal SEL2 if the first video data is full screen data. The second selector 650 outputs the first video data DATA1 and the second video data DATA2 in the second output mode in response to the second select signal SEL2 when the first video data is window data.

In the first output mode, the first video data DATA1 and the second video data DATA2 are alternately output. In the second output mode, the first video data DATA1 is output for a predetermined period of time and then the second video data DATA2 is output for a predetermined period of time. The gate line sorting circuit 435 controls an enabling sequence of first to nth gate line signals used to enable n gate lines of the display panel 470 in response to a fourth control signal CTRL4 according to whether the first video data DATA1 and the second video data DATA2 are output in the first output mode or the second output mode.

Figure 8:
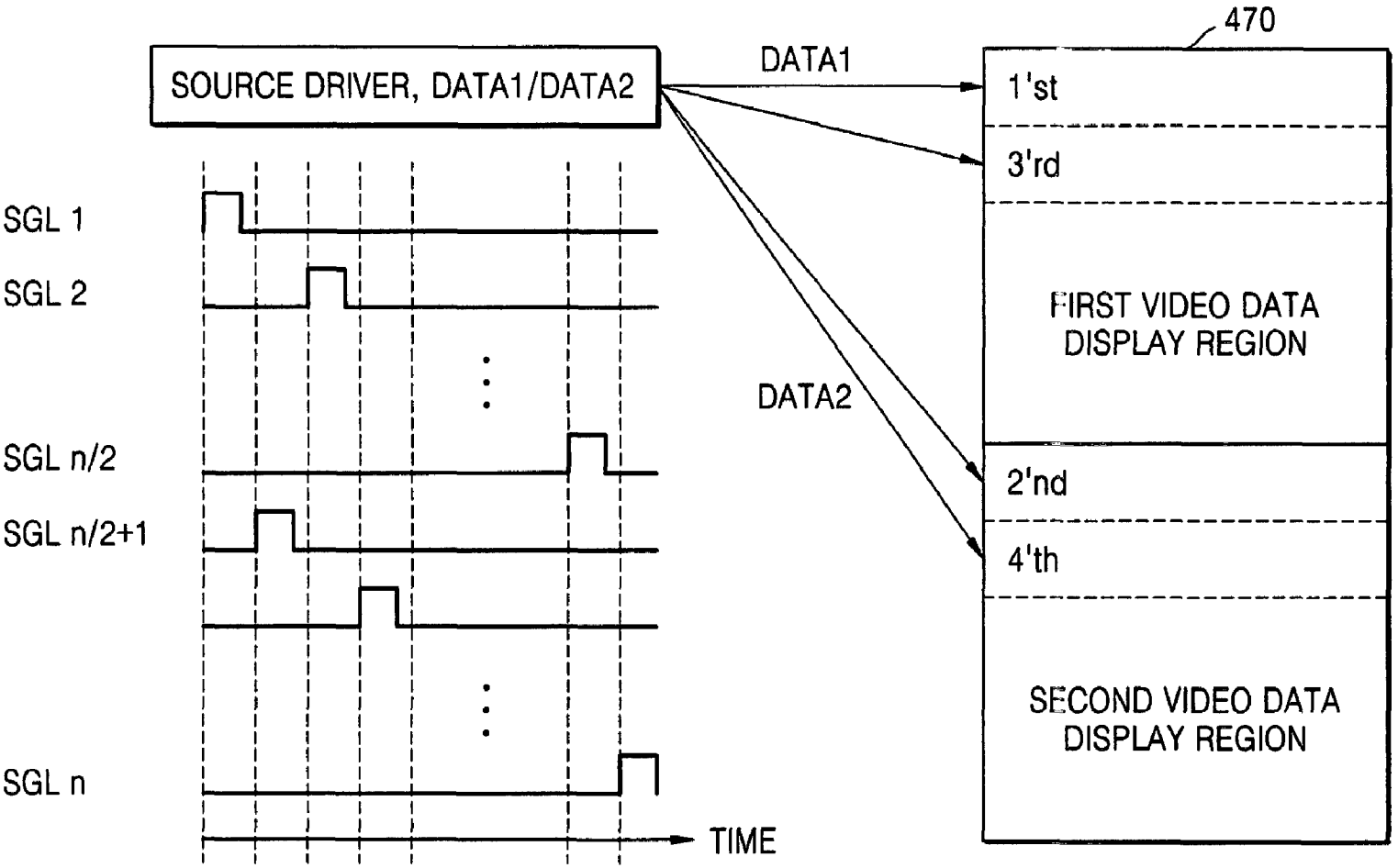
FIG. 8 is a diagram illustrating operations of the gate line sorting circuit of FIG. 4 according to some embodiments of the present invention.
Figure 9:
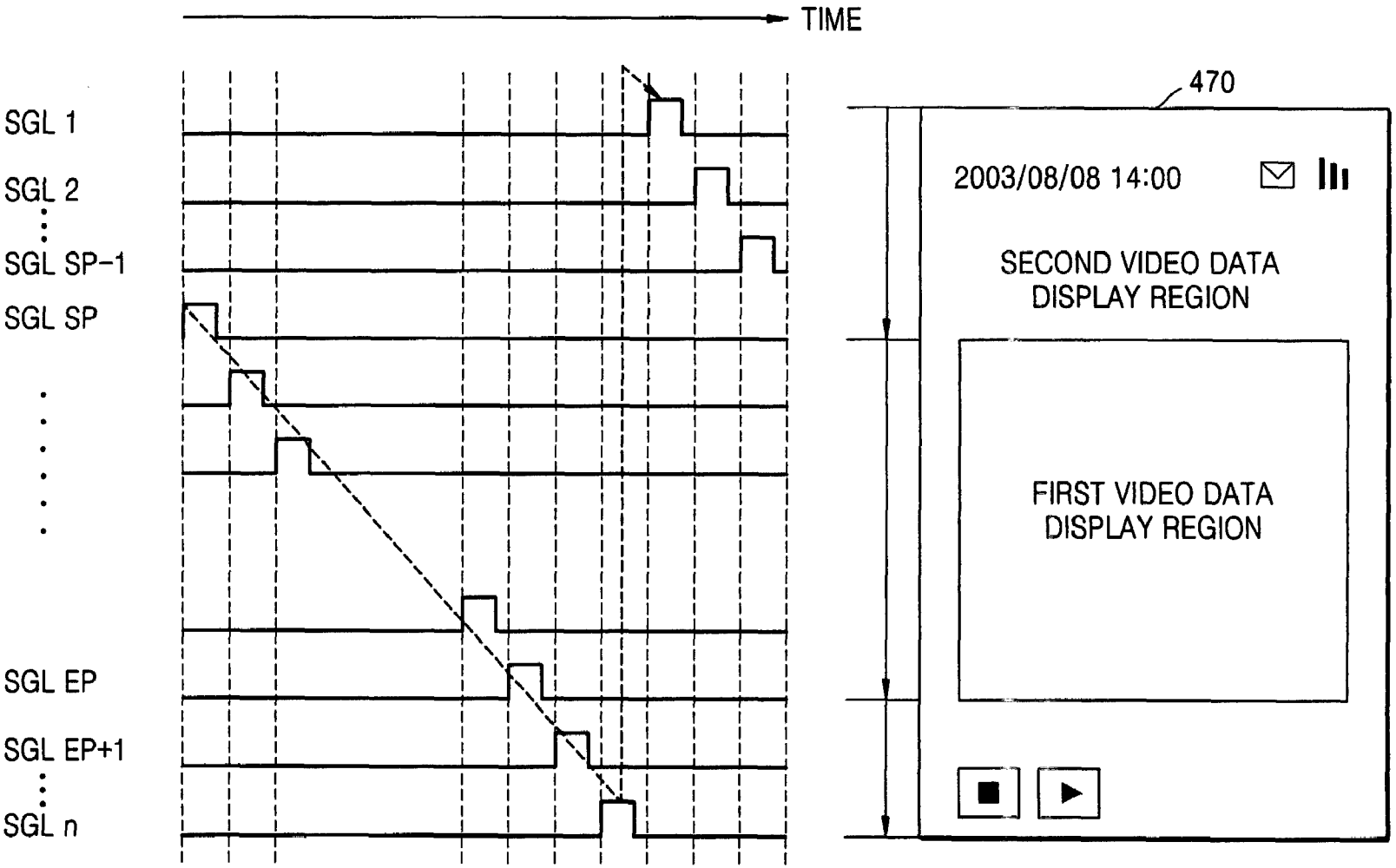
FIG. 9 is a diagram for explaining operations of the gate line sorting circuit of FIG. 4 according to further embodiments of the present invention.

The operation of the gate line sorting circuit 435 will now be explained in more detail with reference to FIGS. 8 and 9. FIG. 8 is a diagram illustrating operation of the gate line sorting circuit 435 of FIG. 4 according to some embodiments of the present invention, and FIG. 9 is a diagram illustrating operation of the gate line sorting circuit of FIG. 4 according to further embodiments of the present invention.

Referring to FIG. 8, there are n gate lines that drive the display panel 470. When the first video data DATA1 and the second video data DATA2 are output in the first output mode, gate line signals SGL1 through SGLn/2 and gate line signals SGLn/2+1 through SGLn are alternately enabled one by one in response to the fourth control signal CTRL4. The first video data DATA1 and the second video data DATA2 are output in the first output mode when the first video data DATA1 is full screen data. In this case, the size of the first video data DATA1 is reduced by half and the corresponding image is displayed on the display panel 470. Accordingly, the first through n/2 gate lines are enabled when the first video data DATA1 is provided to the display panel 470 and the n/2+1 through n gate lines are enabled when the second video data DATA2 is provided to the display panel 470.

For example, after the first gate line signal SGL1 enables the first gate line, the (n/2+1)th gate line signal SGLn/2+1 is enabled to enable the (n/2+1)th gate line. The gate driver 445 enables the first gate line and the (n/2+1)th gate line in response to the enabled first gate line signal SGL1 and the (n/2+1)th gate line signal SGLn/2+1. Subsequently, the second gate line signal SGL2 is enabled and then the (n/2+2)th gate line signal SGLn/2+2 is enabled. This process may be repeated until all n gate lines have been enabled. In this manner, all of the first through nth gate line signals SGL1 through SGLn are enabled.

When the gate driver 445 enables the gate lines according to the first through nth gate line signals SGL1 through SGLn, the source driver 440 transmits the first video data DATA1 and the second video data DATA2 output from the data control circuit 430 to the display panel 470 in response to a sixth control signal CTRL6. The first video data DATA1 and the second video data DATA2 are alternately output from the data control circuit 430 and transmitted to the alternately enabled gate lines of the display panel 470.

Figure 3:
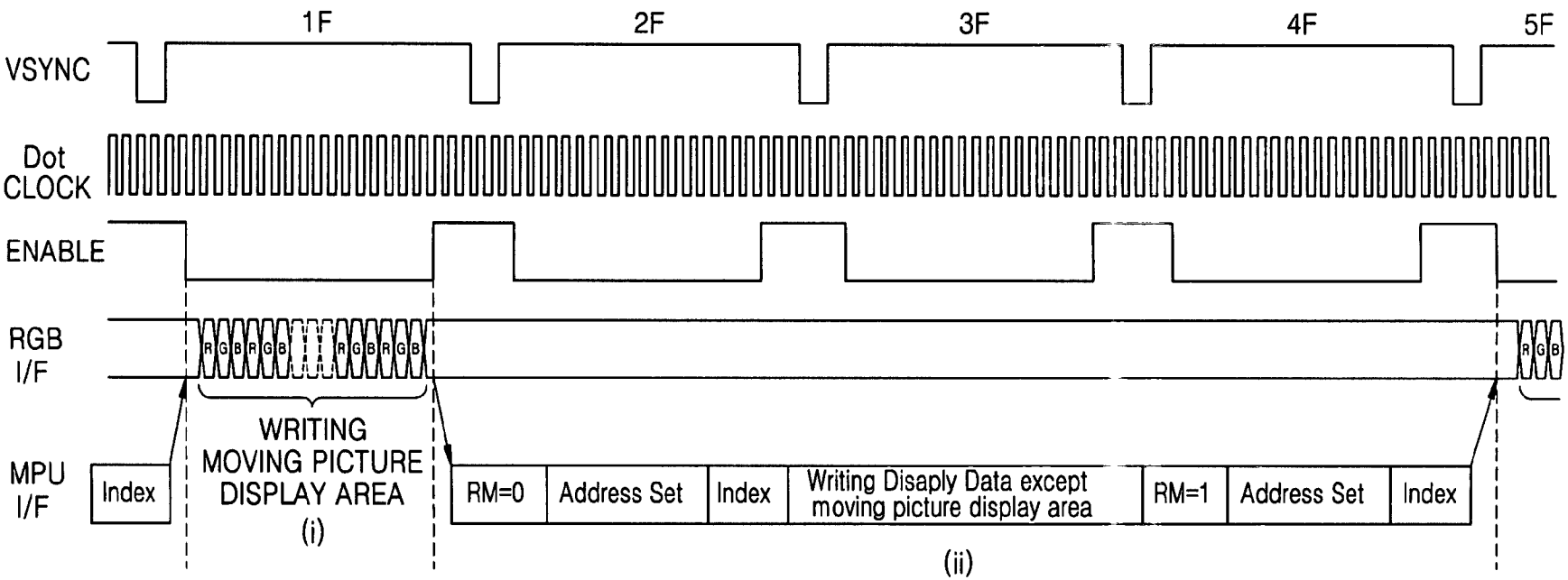
FIG. 3 (PRIOR ART)
FIG. 3 is a timing diagram illustrating the operation of the panel driving circuit of FIG. 2.

While the conventional panel driving circuit typically cannot transmit moving image data when still image data is delivered after the moving image data has been transmitted (referring to FIG. 3), the first video data DATA1 and the second video data DATA2 are alternately transmitted to be displayed at different positions of the display panel 470 in some embodiments of the present invention.

Referring to FIG. 9, the gate line sorting circuit 435 sequentially enables gate line signals SGL SP through SGL EP for enabling gate lines corresponding to the start point SP and end point EP of the first video data DATA1 on a panel line in response to the fourth control signal CTRL4 when the first video data DATA1 and the second video data DATA2 are output in the second output mode. In addition, the gate line sorting circuit 435 sequentially enables a gate line signal SGL EP+1 for enabling a gate line corresponding to the point following the end point EP through a gate line signal SGL SP−1 for enabling a gate line corresponding to a point before the start point SP.

The first video data DATA1 and the second video data DATA2 are output in the second output mode when the first video data DATA1 is window data. In this case, the first video data DATA1 is displayed at a specific position of the display panel 470 and the second video data DATA2 is displayed on the remaining portion of the panel.

As can be seen from FIG. 9, the gate line signals SGL SP through SGL EP for enabling gate lines corresponding to the position where the first video data DATA1 will be displayed on the panel 470 are sequentially enabled first. The gate driver 445 enables corresponding gate lines in response to the gate line signals SGL SP through SGL EP and the source driver 440 transmits the first video data DATA1 output from the data control circuit 430 to the display panel 470.

The gate line signals SGL EP+1 through SGLn and SGL1 through SGL SP−1 for enabling gate lines corresponding to the position where the second video data DATA2 will be displayed are sequentially enabled. In FIG. 9, the gate line signals SGL EP+1 through SGLn are enabled prior to the gate line signals SGL1 through SGL SP−1. However, the gate line signals SGL1 through SGL SP-1 can be enabled first. The gate driver 445 enables corresponding gate lines in response to the gate line signals SGL EP+1 through SGLn and SGL1 through SGL SP−1 and the source driver 440 transmits the second video data DATA2 output from the data control circuit 430 to the display panel 470.

The panel driving circuit 400 further includes the controller 450 that generates the first through sixth control signals CTRL1 through CTRL6. The fifth control signal CTRL5 and the sixth control signal CTRL6 respectively transmitted to the source driver 440 and the gate driver 445 are horizontal synchronous signals.

Figure 10:
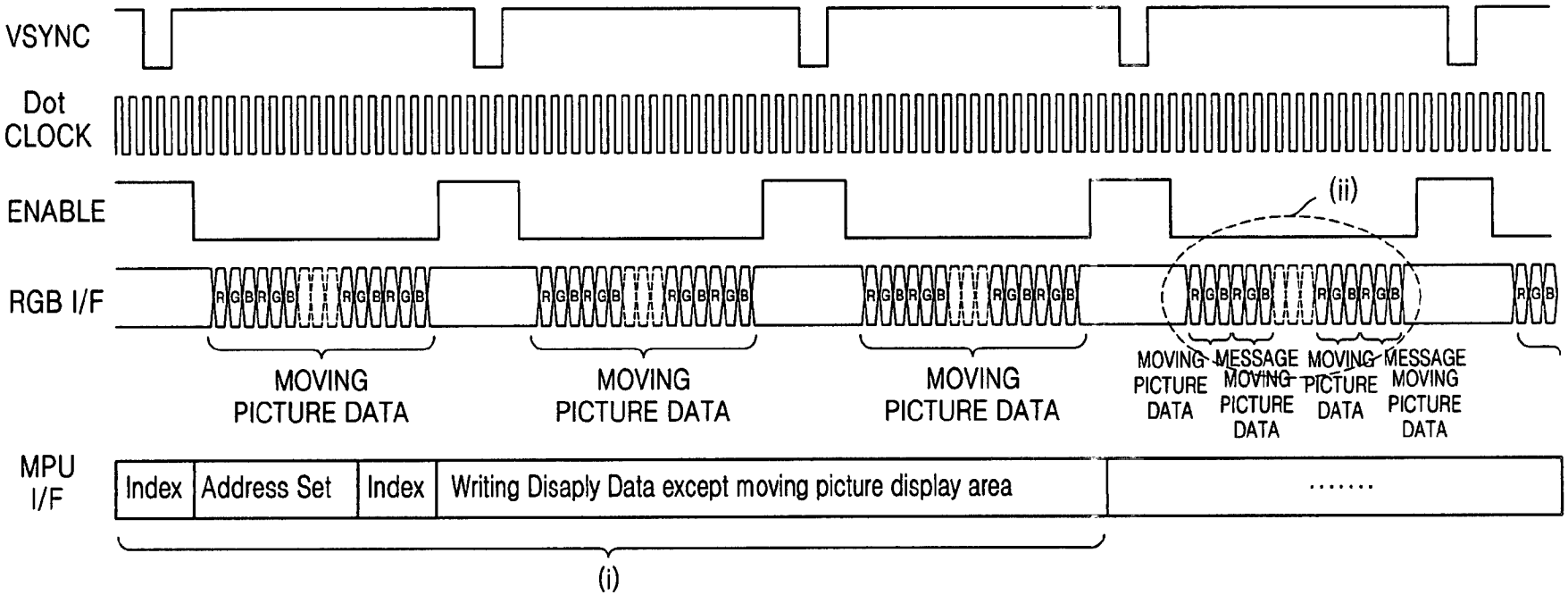
FIG. 10 is a timing diagram illustrating operations of the panel driving circuit of FIG. 4.

FIG. 10 is a timing diagram illustrating the operation of the panel driving circuit of FIG. 4. While the first video data DATA1, that is, moving image data, is being displayed on the display panel 470, the second video data DATA2 is input and stored in the memory 420(i). Then, the first video data DATA1 and the second video data DATA2 are transmitted to the panel 470 in a same frame according to the data control circuit 430 (ii).

Although the moving image data typically cannot be transmitted to the panel in a same frame as the still image data is being delivered to the panel in the conventional panel driving circuit (referring to FIG. 3), the panel driving circuit 400 according to some embodiments of the present invention can solve this problem.

Figure 11:
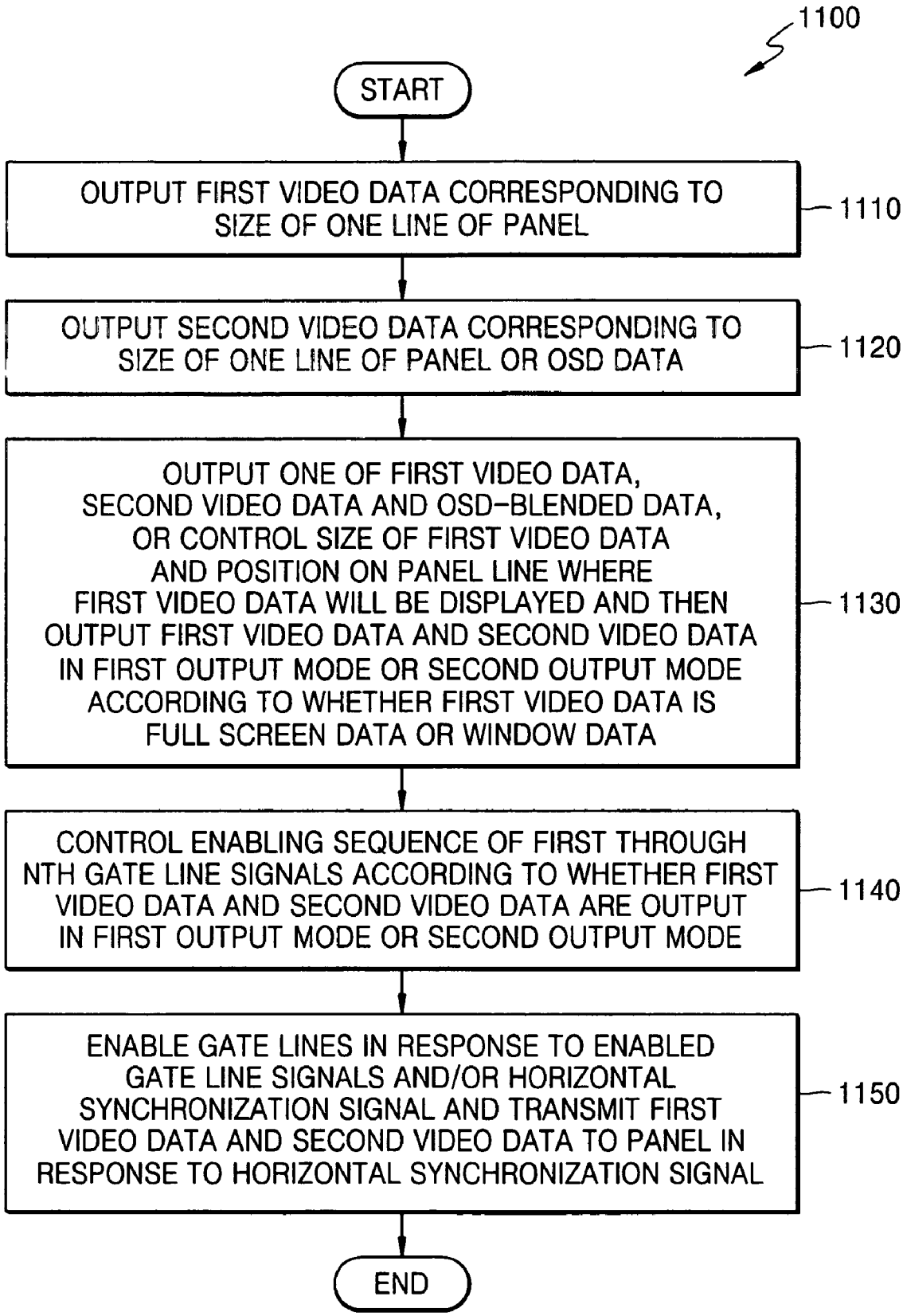
FIG. 11 is a flow chart illustrating panel driving methods according to further embodiments of the present invention.
Figure 12:
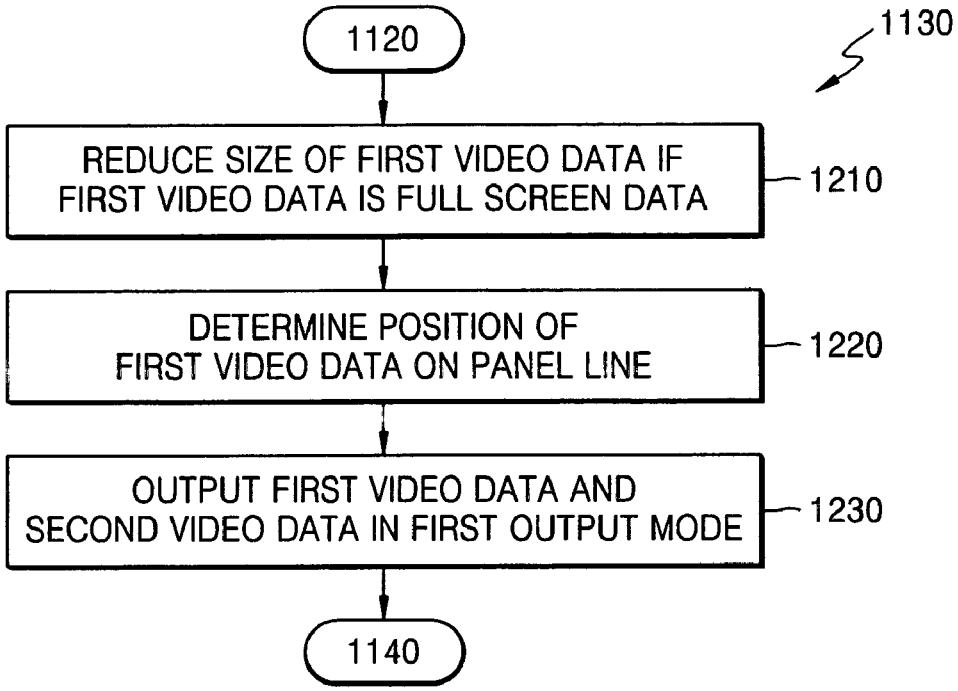
FIG. 12 is a flow chart illustrating panel driving methods according to some embodiments of the present invention when the first video data is full screen data.
Figure 13:
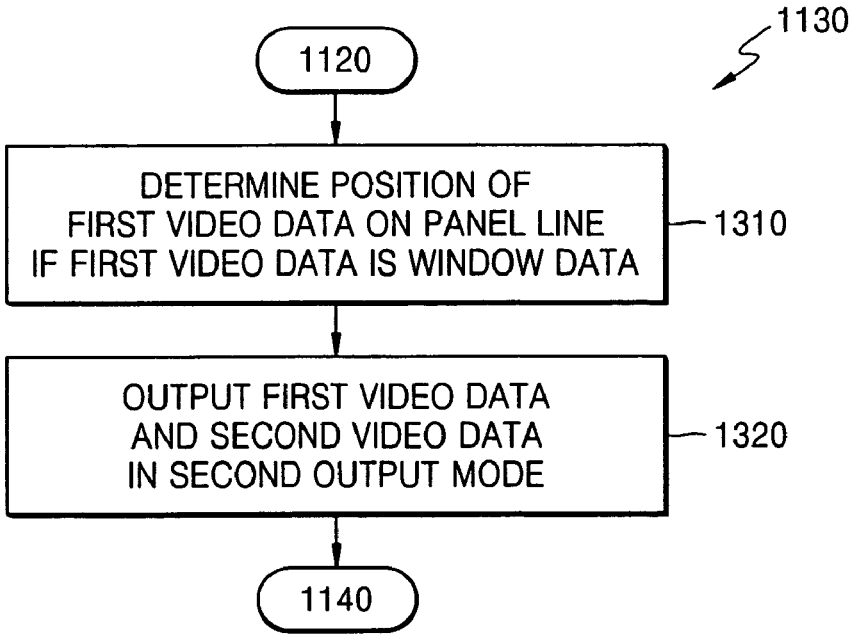
FIG. 13 is a flow chart illustrating the panel driving method when the first video data is window data.

FIG. 11 is a flow chart illustrating panel driving methods according to some embodiments of the present invention. FIG. 12 is a flow chart illustrating panel driving methods when the first video data is full screen data in step 1130 of FIG. 11 and FIG. 13 is a flow chart illustrating panel driving methods when the first video data is window data at step 1130 of FIG. 11.

In the panel driving method 1100, the first video data corresponding to the size of one line of the panel is output (block 1110). In block 1120, the second video data or OSD data corresponding to the size of one line of the panel is output. In block 1130, the first or second video data is output when only one of the first video data and the second video data is received. Otherwise, the first video data and OSD data is received and OSD-blended data in which an image corresponding to the OSD data is displayed on an image corresponding to the first video data is output. The size of the first video data and a position on a panel line where the first video data will be displayed is controlled and then the first video data and the second video data is output in the first output mode or second output mode according to whether the first video data is full screen data that is to be displayed on the entire panel or window data that is displayed at a specific position of the panel. In block 1140, an enabling sequence of first through nth gate line signals for enabling n gate lines of the panel is controlled according to whether the first video data and the second video data are output in the first output mode or second output mode. In block 1150, the gate lines are enabled in response to the enabled gate line signals and/or horizontal synchronous signals and the first video data and the second video data are transmitted to the panel in response to the horizontal synchronous signals.

The operations for driving a display panel that are illustrated in FIG. 11 may be carried out by the panel driving circuit 400 of FIG. 4. That is, the operations of block 1110 may be provided by the shift register 410 and the operations of block 1120 may be provided by the memory 420. In addition, the operations of blocks 1130 and 1140 may be provided by the data control circuit 430 and gate line sorting circuit 435, respectively. The operations of block 1150 may be provided by the source driver 440 and gate driver 445.

Turning to FIG. 12, when the first video data is full screen data in block 1130, the data control circuit 430 reduces the size of the first video data (block 1210), decides the position of the first video data on a panel line (block 1220), and outputs the first video data and the second video data in the first output mode (block 1230).

Turning to FIG. 13, when the first video data is window data in block 1130, the data control circuit 430 determines the position of the first video data on the panel line (block 1310) and outputs the first video data and the second video data in the second output mode (block 1320). The operations in blocks 1210, 1220, 1230, 1310 and 1320 may be provided as described above with referent to the line packing circuit 520.

As described above, display panel driving circuits and methods of driving the same according to the present invention can reduce the size of a moving image displayed when a still image is input while the moving image is being displayed and display the still image together with the moving image. Furthermore, in some embodiments of the present invention, unnecessary power consumption can be decreased because moving image data is not stored in a memory. Moreover, a separate OSD memory need not be used, which may reduce circuit area.

While embodiments of the present invention have been described with reference to enabling gate lines of a display pane embodiments of the present invention should not be construed as limited to device utilizing gate lines but may be applicable in any display device where lines of the display device are individually enabled.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A display panel driving circuit, comprising:

a shift register configured to store first video data corresponding to a size of one line of a panel in response to a first control signal;

a memory configured to store second video data in response to a second control signal and output an amount of the second video data corresponding to the size of one line of the panel;

a line packing circuit configured to control a size of the first video data output from the shift register and a position of the first video data on the display panel, and output the first video data and the second video data in a first output mode or a second output mode in response to a third control signal;

a gate line sorting circuit configured to control an enabling sequence of first through nth gate line signals for enabling n gate lines of the panel in response to a fourth control signal according to whether the first video data and the second video data are output in the first output mode or second output mode;

a gate driver circuit configured to enable gate lines of the display panel in response to the gate line signals output from the gate line sorting circuit and a fifth control signal; and a source driver circuit configured to provide the first video data and the second video data output from the line packing circuit to the display panel in response to a sixth control signal, wherein, in the first output mode, the first and second video data are alternately output, and in the second output mode, the first video data is output for a first predetermined period of time and then the second video data is output for a second predetermined period of time.

2. The display panel driving circuit of claim 1, wherein the line packing circuit comprises:

a size controller configured to reduce the size of the first video data if the first video data is full screen data;

a first data position determining unit configured to determine a position of the first video data output from the size controller on a panel line;

a second data position determining unit configured to determine a position of the first video data on a panel line when the first video data is window data that is displayed at a specific position on the display panel;

a first selector configured to output the first video data output from the first data position determining unit or the first video data output from the second data position determining unit in response to a first select signal; and a second selector configured to output the first video data output from the first selector or the second video data in response to a second select signal.

3. The display panel driving circuit of claim 2, wherein the first and second select signals are generated based on the third control signal.

4. The display panel driving circuit of claim 2, wherein the second selector outputs the first video data and the second video data in the first output mode in response to the second select signal if the first video data is full screen data, and outputs the first video data and the second video data in the second output mode in response to the second select signal when the first video data is window data.

5. The display panel driving circuit of claim 2, wherein the size controller reduces the size of the first video data by half.

6. The display panel driving circuit of claim 1, wherein the gate line sorting circuit alternately sequentially enables gate line signals for a first half of the display panel and gate line signals for a second half of the display panel in response to the fourth control signal when the first video data and the second video data are output in the first output mode.

7. The display panel driving circuit of claim 1, wherein the gate line sorting circuit sequentially enables gate line signals corresponding to display panel lines from a start point through an end point of the first video data and then sequentially enables gate line signals corresponding display panel lines from a point after the end point to a point before the start point of the first video data in response to the fourth control signal when the first video data and the second video data are output in the second output mode.

8. The display panel driving circuit of claim 1, further comprising a controller configured to generate the first through sixth control signals, the fifth and sixth control signals being horizontal synchronization signals.

9. The display panel driving circuit of claim 1, wherein the first video data is moving image data and the second video data is moving image data and/or still image data.

10. A method of driving a display panel, comprising:

obtaining first video data from a first source corresponding to a size of one line of the display panel;

obtaining second video data from a second source corresponding to the size of one line of the display panel;

controlling the size of the first video data and a position of a display panel line where the first video data will be displayed and outputting the first video data and the second video data in a first output mode or second output mode according to whether the first video data is full screen data that is displayed on the entire screen of the panel or window data that is displayed at a specific position of the panel;

controlling an enabling sequence of first through nth gate line signals for enabling n gate lines of the display panel according to whether the first video data and the second video data are output in the first output mode or second output mode;

enabling gate lines in the enabling sequence; and providing a corresponding one of the first video data and the second video data to the panel when a corresponding one of the gate lines are enabled.

11. The method of claim 10, wherein in the first output mode, the first video data and the second video data are alternately output and in the second output mode, the first video data is output for a first predetermined period of time and the second video data is output for a second predetermined period of time to sequentially output the first video data and the second video data.

12. The method of claim 10, wherein controlling the size of the first video data and a position of a display panel line where the first video data will be displayed and outputting the first video data and the second video data in a first output mode or a second output mode comprises:

reducing the size of the first video data if the first vide data is full screen data;

determining a position of the first video data on a panel line; and outputting the first video data and the second video data in the first output mode.

13. The method of claim 12, further comprising:

determining a position of the first video data on a panel line if the first video data is window data; and outputting the first video data and the second video data in the second output mode.

14. The method of claim 12, wherein, reducing the size of the first video data comprises decreasing the size of the first video data by half.

15. The method of claim 10, wherein controlling an enabling sequence of the first to nth gate line signals comprises controlling the enabling sequence where gate line signals following the first gate line signal and signals following the (n/2+1)th gate line signal are alternately enabled sequentially when the first video data and the second video data are output in the first output mode.

16. The method of claim 10, wherein controlling an enabling sequence of the first to nth gate line signals comprises controlling the enabling sequence where gate line signals for enabling gate lines corresponding to a start point through to an end point of the first video data on the display panel line are sequentially enabled, and then gate line signals corresponding to a point after the end point to a point before the start point are sequentially enabled when the first video data and the second video data are output in the second output mode.

17. The method of claim 10, wherein the first video data is moving image data and the second video data is moving image data or still image data.

18. A display panel driving circuit comprising:

a shift register configured to store first video data corresponding to a size of one line of a panel in response to a first control signal;

a memory configured to store second video data or OSD data input thereto and output an amount of the second video data or OSD data corresponding to the size of one line of the panel in response to a second control signal;

a data control circuit configured to output a corresponding one of the first or second video data when only one of the first video data and the second video data is received, receive the first video data and the OSD data and output OSD-blended data, and receive the first video data and the second video data and output them in a first output mode or a second output mode in response to a third control signal;

a gate line sorting circuit configured to control an enabling sequence of first through nth gate line signals for enabling n gate lines of the panel in response to a fourth control signal according to whether the first video data and the second video data are output in a first output mode or a second output mode;

a gate driver configured to enable gate lines of the display panel in response to the gate line signals output from the gate line sorting circuit and a fifth control signal; and a source driver configured to provide the first video data and the second video data output from the data control circuit to the display panel in response to a sixth control signal.

19. The display panel driving circuit of claim 18, wherein in the first output mode, the first video data and the second video data are alternately output and in the second output mode, the first video data is output for a predetermined period of time and then the second video data is output for a predetermined period of time.

20. The display panel driving circuit of claim 19, wherein the data control circuit comprises:

an alpha-blending circuit configured to blend the first video data with the OSD data in a specific ratio to produce the OSD-blended data;

a line packing circuit configured to control the size of the first video data and a position on a display panel line where the first video data will be displayed and output the first video data and the second video data in the first output mode or second output mode in response to the third control signal; and a selecting circuit configured to select the first video data when only the first video data is received, the second video data when only the second video data is received, the OSD-blended data or the output of the line packing circuit in response to an operation mode select signal.

21. The display panel driving circuit of claim 20, wherein the line packing circuit further comprises:

a size controller configured to reduce the size of the first video data;

a first data position determining unit configured to determine a position of the first video data output from the size controller on a display panel;

a second data position determining unit configured to determine a position of the first video data on a display panel when the first video data is window data that is displayed at a specific position on the panel;

a first selector circuit configured to output the first video data output from the first data position determining unit or the first video data output from the second data position determining unit in response to a first select signal; and a second selector circuit configured to output the first video data output from the first selector circuit or the second video data in response to a second select signal.

22. The display panel driving circuit of claim 21, wherein the first and second select signals are generated from the third control signal.

23. The display panel driving circuit of claim 22, wherein the second selector circuit alternately outputs the first video data and the second video data in the first output mode in response to the second select signal if the first video data is full screen data, and sequentially outputs the first video data and the second video data in the second output mode in response to the second select signal when the first video data is window data.

24. The display panel driving circuit of claim 21, wherein the size controller reduces the size of the first video data by half.

25. The display panel driving circuit of claim 18, wherein the gate line sorting circuit alternately sequentially enables gate line signals for a first half of the display panel and gate line signals for a second half of the display panel in response to the fourth control signal when the first video data and the second video data are output in the first output mode.

26. The display panel driving circuit of claim 18, wherein the gate line sorting circuit sequentially enables gate line signals corresponding to display panel lines from a start point through an end point of the first video data and then sequentially enables gate line signals corresponding display panel lines from a point after the end point to a point before the start point of the first video data in response to the fourth control signal when the first video data and the second video data are output in the second output mode.

27. The display panel driving circuit of claim 18, further comprising a controller configured to generate the first through sixth control signals, the fifth and sixth control signals being horizontal synchronization signals.

28. The display panel driving circuit of claim 18, wherein the first video data is moving image data and the second video data is moving image data or still image data.

29. The panel driving circuit of claim 18, further comprising:

a moving image interface configured to receive the first video data and transmitting it to the shift register; and a microprocessor interface configured to receive the OSD data or the second video data and transmitting it to the memory.

30. A method of driving a display panel, comprising:

obtaining first video data corresponding to a size of one line of a display panel;

obtaining second video data or OSD data corresponding to the size of one line of the display panel;

outputting the first or second video data when only one of the first video data and the second video data is received, outputting OSD-blended data in which an image corresponding to the OSD data is displayed on an image corresponding to the first video data when first video data and OSD data is received, or controlling the size of the first video data and a position on a panel line where the first video data will be displayed and outputting the first video data and the second video data in a first output mode or a second output mode according to whether the first video data is full screen data or window data;

controlling an enabling sequence of first through nth gate line signals for enabling n gate lines of the panel according to whether the first video data and the second video data are output in the first output mode or second output mode; and enabling gate lines in response to the enabled gate line signals and/or horizontal synchronization signals and providing the first video data and the second video data to the display panel in response to the horizontal synchronization signals.

31. The method of claim 30, wherein in the first output mode, the first video data and the second video data are alternately output and in the second output mode, the first video data is output for a first predetermined period of time and then the second video data is output for a second predetermined period of time.

32. The method of claim 30, wherein outputting the first video data and the second video data in the first output mode or second output mode comprises:

reducing a size of the first video data if the first video data is full screen data;

determining a position of the first video data on a display panel; and outputting the first video data and the second video data in the first output mode.

33. The method of claim 32, wherein outputting the first video data and the second video data in the first output mode or second output mode further comprises:

determining a position of the first video data on a display panel if the first video data is window data; and outputting the first video data and the second video data in the second output mode.

34. The method of claim 33, further comprising blending the first video data with the OSD data in a predetermined ratio and outputting the OSD-blended data when the first video data and the OSD data are received, wherein the first video data is selected and output when only the first video data is received, the second video data is selected and output when only the second video data is received, or the OSD-blended data and data output in the first output mode or second output mode is selected and output.

35. The method of claim 32, wherein reducing the size of the first video data comprises decreasing the size of the first video data by half.

36. The method of claim 30, wherein controlling an enabling sequence of the first to nth gate line signals comprises controlling the enabling sequence where gate line signals following the first gate line signal and signals following the (n/2+1)th gate line signal are alternately enabled sequentially when the first video data and the second video data are output in the first output mode.

37. The method of claim 30, wherein controlling an enabling sequence of the first to nth gate line signals comprises controlling the enabling sequence where gate line signals for enabling gate lines corresponding to a start point through to an end point of the first video data on the display panel line are sequentially enabled, and then gate line signals corresponding to a point after the end point to a point before the start point are sequentially enabled when the first video data and the second video data are output in the second output mode.

38. The method of claim 30, wherein the first video data is moving image data and the second video data is moving image data or still image data.

* * * * *